US007587846B2

(12) United States Patent
Khan

(10) Patent No.: US 7,587,846 B2
(45) Date of Patent: Sep. 15, 2009

(54) MAILBOX COVER

(76) Inventor: Farhan Khan, 5300 McIntosh Point, Sanford, FL (US) 32773

( * ) Notice: Subject to any disclaimer, the term of this patent is extended or adjusted under 35 U.S.C. 154(b) by 85 days.

(21) Appl. No.: 12/055,354

(22) Filed: Mar. 26, 2008

(65) Prior Publication Data

US 2008/0172916 A1 Jul. 24, 2008

Related U.S. Application Data

(63) Continuation of application No. 11/521,826, filed on Sep. 15, 2006, now abandoned.

(51) Int. Cl.
*A47G 29/122* (2006.01)

(52) U.S. Cl. ..... 40/606.06; 40/600; 232/17; 232/38; D99/30

(58) Field of Classification Search ..... 40/606.06, 40/600; 232/17, 38; D99/30, 31
See application file for complete search history.

(56) References Cited

U.S. PATENT DOCUMENTS 4,991,769 A * 2/1991 Todd ..... 232/17
5,178,321 A * 1/1993 Majewski ..... 232/17
6,484,428 B1 * 11/2002 Greenwald et al. ..... 40/600
6,840,773 B2 * 1/2005 Anderson et al. ..... 434/73
2002/0092901 A1 * 7/2002 Paschal ..... 232/38

* cited by examiner

*Primary Examiner*—Cassandra Davis
(74) *Attorney, Agent, or Firm*—McKinney Law, PLLC

(57) ABSTRACT

A mailbox cover comprising a flexible sheet having a composite of a plurality of layers. The layers having a first layer decorated with graphics and an underlying second layer magnetically polarized in a first direction so that the second layer is magnetically attracted to a metal mailbox. The plurality of layers further comprising an underlying third layer magnetically polarized in an opposing second direction to the second magnetically polarized layer so that the third layer is magnetically attracted to a metal mailbox. An underlying fourth layer is decorated with graphics. The sheet further comprising a perforated cuts parallel to preselected edges of the sheet so that the perforated cuts allow strips of the sheet to be removed to reduce the length and width of the sheet to adapt to different sizes of mailboxes.

13 Claims, 7 Drawing Sheets

MAILBOX COVER

1. CROSS-REFERENCE TO RELATED APPLICATION

This application is a continuation of U.S. patent application Ser. No. 11/521,826 filed Sep. 15, 2006 now abandoned, entitled "Mailbox Cover."

2. FIELD OF THE INVENTION

The present invention relates generally to a cover for a typical rural mailbox, and more specifically to an adaptable cover for a mailbox having a layer of magnetized material.

3. DESCRIPTION OF THE PRIOR ART

Mailboxes are used by the U.S. Postal service to collect and distribute letters and packages across the nation. One particular type of mailbox approved by the Postmaster General is typically used in rural environments and consists of a rectangular shaped box with an arched top to help shed water. A door is hingedly connected to the lower front of this type of mailbox and swings downward to open to insert and remove contents. The mailbox is mounted atop a post proximate to the roadway at the curbside. The standard mailbox described above is metal and not aesthetically pleasing.

There are three sizes of curbside mailboxes. For example, the T1 (traditional) and C1 (contemporary) are approximately 19 inches in length, 7 inches in width and 9 inches in height; the T2 and C2 are approximately 20 inches in length, 9 inches in width and 11 inches in height; and the T3 and C3 are approximately 24 inches in length, 12 inches in width and 15 inches in height.

There have been attempts to decorate the typical curbside mailbox to improve its aesthetical appeal. These attempts include permanently changing the appearance of a mailbox by painting. However, the mailbox is not easy to change according to an owner's desire once painted and it is desirable to have a mailbox that is capable of changing its appearance quickly and inexpensively.

Other attempts at temporarily changing a mailbox's appearance have been made such as placing a removable cover over the mailbox. By way of example, note U.S. Pat. No. 4,991,769 to Todd that discloses a mailbox cover that has a pair of strips of magnetic material that are adhesively secured to the cover itself. The thin pair of strips of magnetic material along the edges of the cover is the sole source of attachment of the cover to a mailbox. A shortcoming of this prior art is that the mailbox cover is not solidly affixed to the mailbox at all points of contact. Therefore, it is susceptible to the elements by being blown off the mailbox by the wind or allowing moisture underneath the cover. Another shortcoming is that the cover is not adaptable to various sizes of standard curbside mailboxes.

Another example of a removable cover is U.S. Pat. No. 6,929,173 to Toussant et. al that describes a decorative cover for a mailbox door. The cover is made from a flexible sheet of magnetic material having graphics on a first surface of the cover and the magnetic polarity of the cover is focused on a second surface of the cover for attachment to a metal mailbox. It does not cover the body of a mailbox.

Another shortcoming of the prior art mailbox covers is that they are made of polypropelene materials or coated paper that are susceptible to creases, folds and have difficulty in holding firmly to a curved surface.

Notwithstanding the existence of such prior art mailbox covers, there is a need for an improved removable mailbox cover that is adaptable to different sizes and shapes of standard curbside mailboxes and a mailbox cover having improved efficacy in holding power to the mailbox itself. There is also a need for a mailbox cover having graphics displayed on both surfaces (i.e., reversible)

It is, therefore, to the effective resolution of the aforementioned problems and shortcomings of the prior art that the present invention is directed.

However, in view of the prior art at the time the present invention was made, it was not obvious to those of ordinary skill in the pertinent art how the identified needs could be fulfilled.

SUMMARY OF THE INVENTION

This invention is a mailbox cover comprising a flexible sheet having a plurality of layers, said plurality of layers having a first layer decorated with graphics and an underlying second layer magnetically polarized in a first direction so that said second layer is magnetically attracted to a metal mailbox, said plurality of layers further comprising an underlying third layer magnetically polarized in an opposing second direction to said second magnetically polarized layer so that said third layer is magnetically attracted to a metal mailbox and an underlying fourth layer decorated with graphics, said flexible sheet further comprising a first perforated tab disposed proximate to an edge of said sheet and defined by a first perforated cut wherein said first perforated tab having the ability to be folded back underneath said sheet forming a first notch in said sheet so that a mailbox flag is allowed passage, said flexible sheet further comprising a second perforated tab equidistantly disposed between said first tab and a third perforated tab wherein said second tab is defined by a second perforated cut and said third tab defined by a third perforated cut, said second tab is removable to form a second notch so that a mailbox latch operates without interference from said cover, said third tab having the ability when in use to be folded back underneath said sheet forming a third notch in said sheet so that a mailbox flag is allowed passage, said sheet further comprising a rear perforated cut parallel to a rear edge of said sheet so that said rear perforated cut allows a strip of said sheet to be removed to reduce the length of said sheet, and said sheet further comprising a pair of longitudinal perforated cuts disposed parallel to opposing longitudinal edges of said sheet so that said pair of longitudinal perforated cuts allow two strips of said sheet to be removed to reduce the width of said sheet.

It is therefore an object of the present invention to provide for an improvement that overcomes the aforementioned inadequacies of the prior art and provides a significant contribution to the advancement of mailbox covers.

Another object of the present invention is to provide a mailbox cover with the improved ability to maintain its shape to properly and snugly fit to the sides and top of a mailbox.

Another object of the present invention is to provide a mailbox cover that is reversible to show decorative graphics on both sides.

Another object of the present invention is to provide a mailbox cover that is adaptable to display address numbers.

Another object of the present invention is to provide a mailbox cover that is adaptable to a variety of sizes of mailboxes.

Another object of the present invention is to provide a mailbox cover that envelops the entire mailbox.

Still another object of the present invention is to provide a mailbox cover that is durable to the elements and protects the mailbox.

Yet another object of the present invention is to provide a mailbox cover that has improved holding power.

Another object of the present invention is to provide a mailbox cover that is aesthetically pleasing.

Both the foregoing general description and the following detailed description are explanatory and are not restrictive of the invention as claimed. The accompanying drawings, which are incorporated in and constitute part of the specification, illustrate embodiments of the present invention and together with the general description, serve to explain principles of the present invention.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
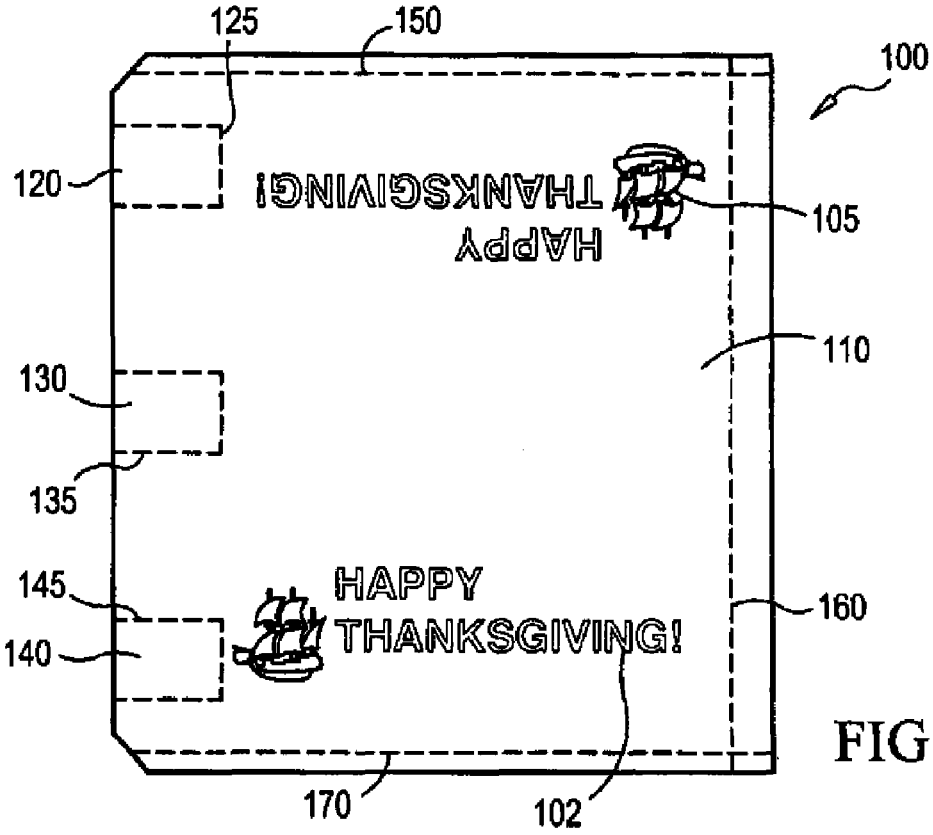
FIG. 1 is a plan view of a first side of the cover of an embodiment of the present invention.

FIG. 1 shows the present mailbox cover that comprises generally a flexible rectangular shaped sheet 100. The sheet 100 is properly sized so that it can be placed over a standard curbside mailbox. A first planar side 110 of the sheet 100 has decorative graphics 102, 105 displayed thereon.

Along a front edge of the sheet 100 are three perforated tabs partially cut through sheet 100. A first perforated tab 120 is disposed proximate to an edge of sheet 100 and defined by a partial cut 125. The first perforated tab 120 can be partially separated from sheet 100 to allow passage of a mailbox flag 127. A second perforated tab 130 is equidistantly disposed between first tab 120 and a third perforated tab 140. The second perforated tab 130 is defined by a partial cut 135. The second tab 130 can be completely separated from sheet 100 so as to prevent any interference between the sheet 100 and a friction latch 137 of a mailbox. In an alternative embodiment, second perforated tab is eliminated. The third tab 140 is defined by a partial cut 145 and similar to tab 120 can be partially separated from sheet 100 to allow passage of a mailbox flag.

Perforated partial cuts 150 and 170 are parallel to opposing longitudinal edges of sheet 100 and disposed so that excess material of sheet 100 can be easily removed to accommodate a mailbox with a smaller width and height such as the standard T1 and C1. Similarly, partial cut 160 is parallel to a rear edge of sheet 100 and is positioned so that excess material of sheet 100 can be easily removed to accommodate a mailbox with a shorter length.

Figure 2:
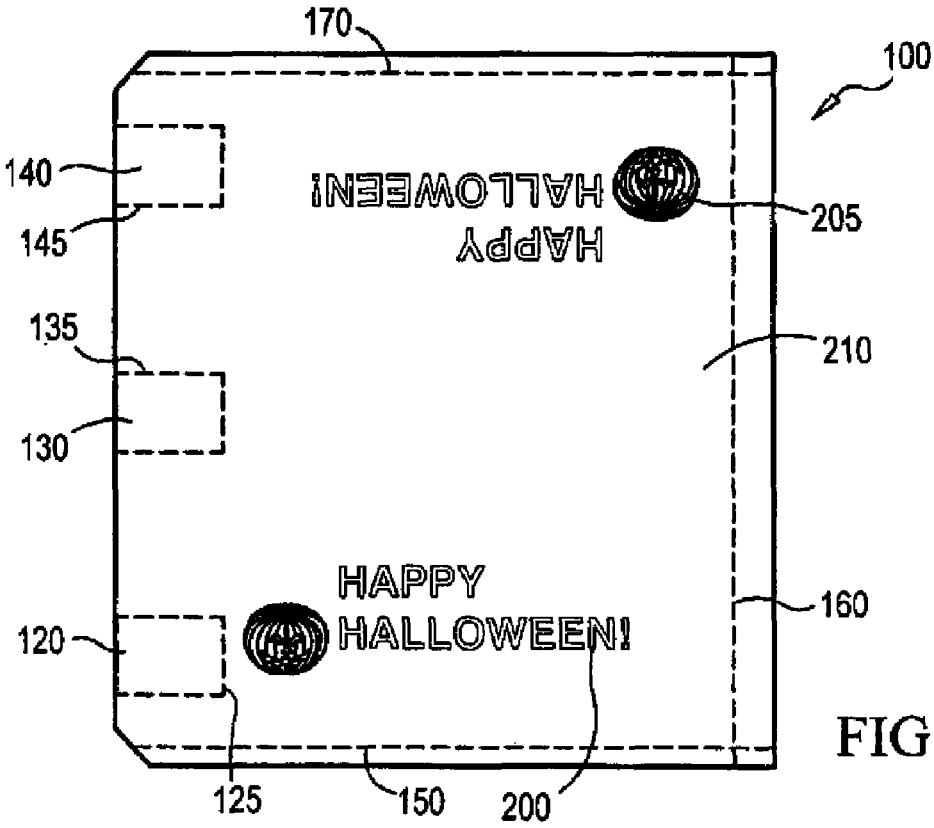
FIG. 2 is a plan view of a second side of the cover of an embodiment of the present invention.
Figure 3:
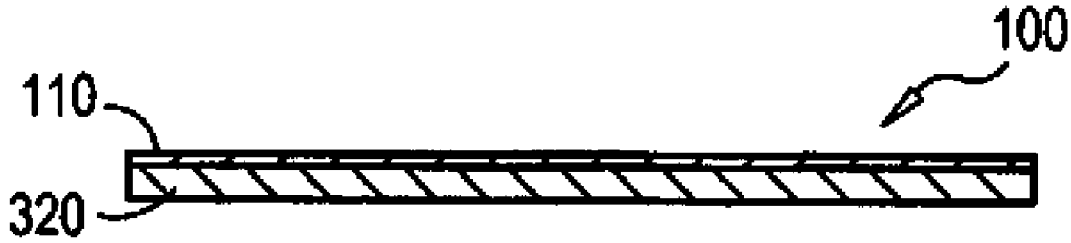
FIG. 3 is a cross sectional view of an alternative embodiment of the present invention.

Referring now to FIG. 2, a second planar side 210 of sheet 100 is shown. The second side 210 of sheet 100 shown in FIG. 2 shows decorative graphics 200, 205 shown thereon. In an alternative embodiment, second side 210 does not have graphics 200, 205, but rather is a layer of magnetized material 320 as shown in FIG. 3 as a cross section of sheet 100. Layer 320 is polarized so that its magnetic properties are attracted to a metal mailbox as sheet 100 is placed with the decorative graphics 110 facing outward and is not reversible.

Figure 4:
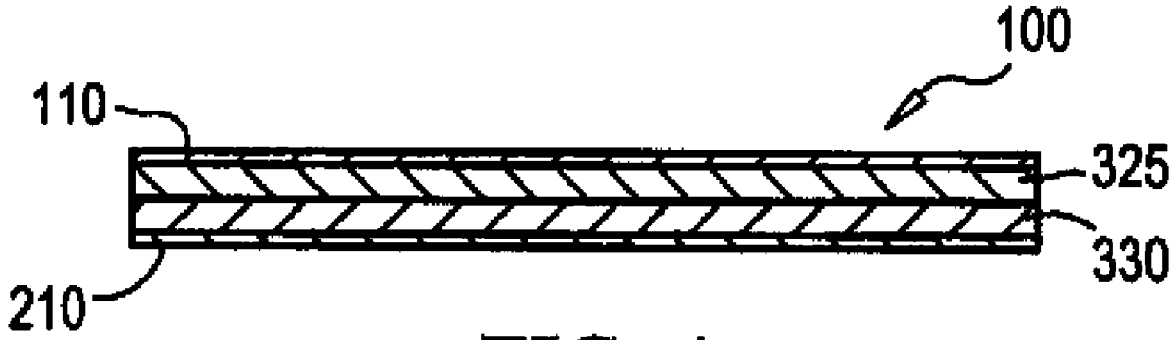
FIG. 4 is a cross sectional view of the preferred embodiment of the present invention.
Figure 8:
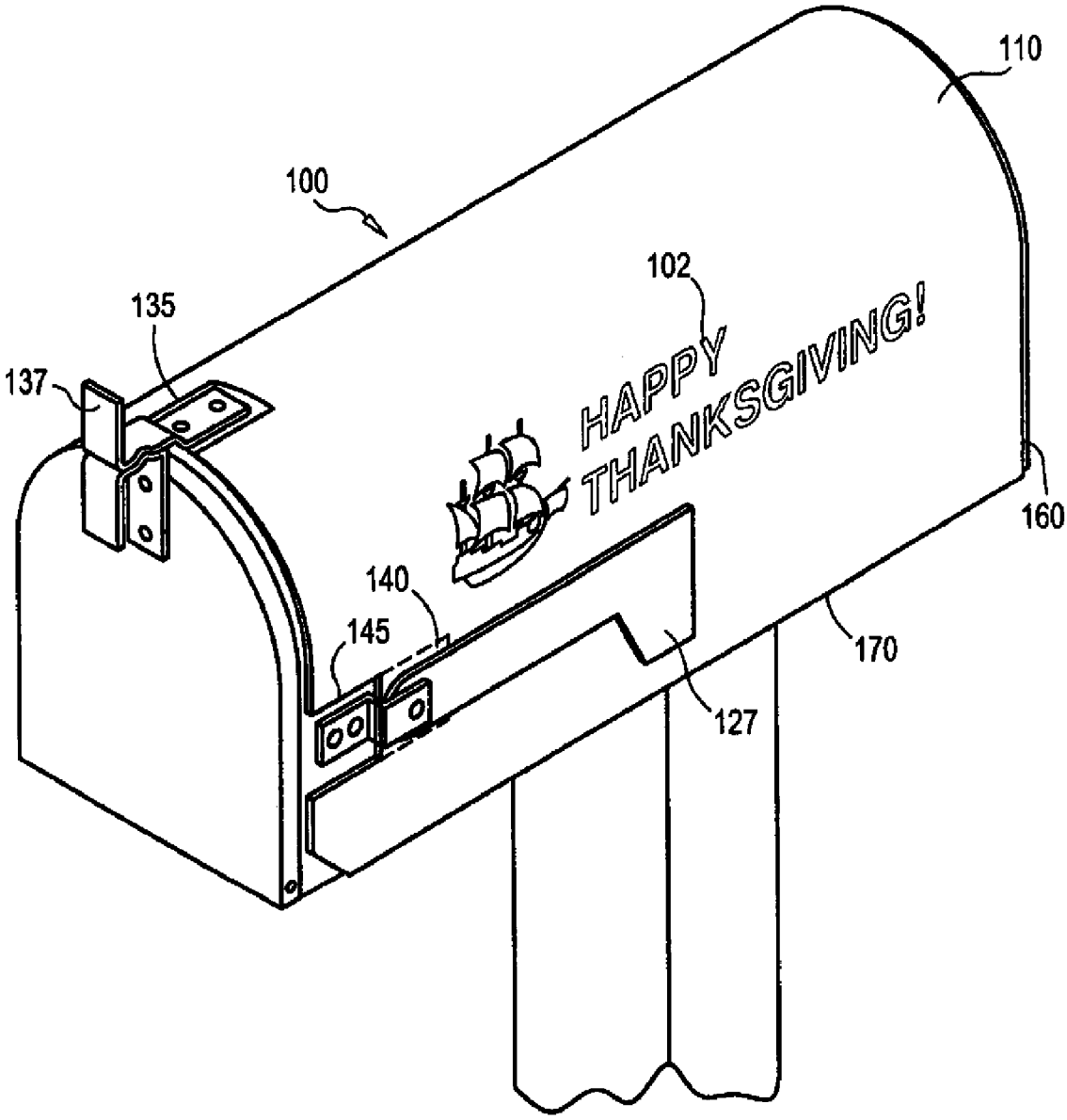
FIG. 8 is a perspective view of a mailbox with the cover installed thereon in accordance with an embodiment of the present invention.

However, in the preferred embodiment, a composite of the layers including decorative layer 110 is overlying a polarized magnetic layer 325, which is overlying an opposingly polarized magnetic layer 330 and decorative graphics 210 as shown in FIG. 4 as a cross section. The magnetic polarization of layer 330 is such that its attractive magnetic forces pass through decorative layer 210 which is placed over a mailbox and with the decorative graphics 102 facing outward as shown in FIG. 8. In an alternative embodiment opposingly polarized layers 325, 330 are comprised of only one layer (not shown) of polarized material having one side magnetically polarized in a first direction and a second side magnetically polarized in an opposing direction.

Figure 5:
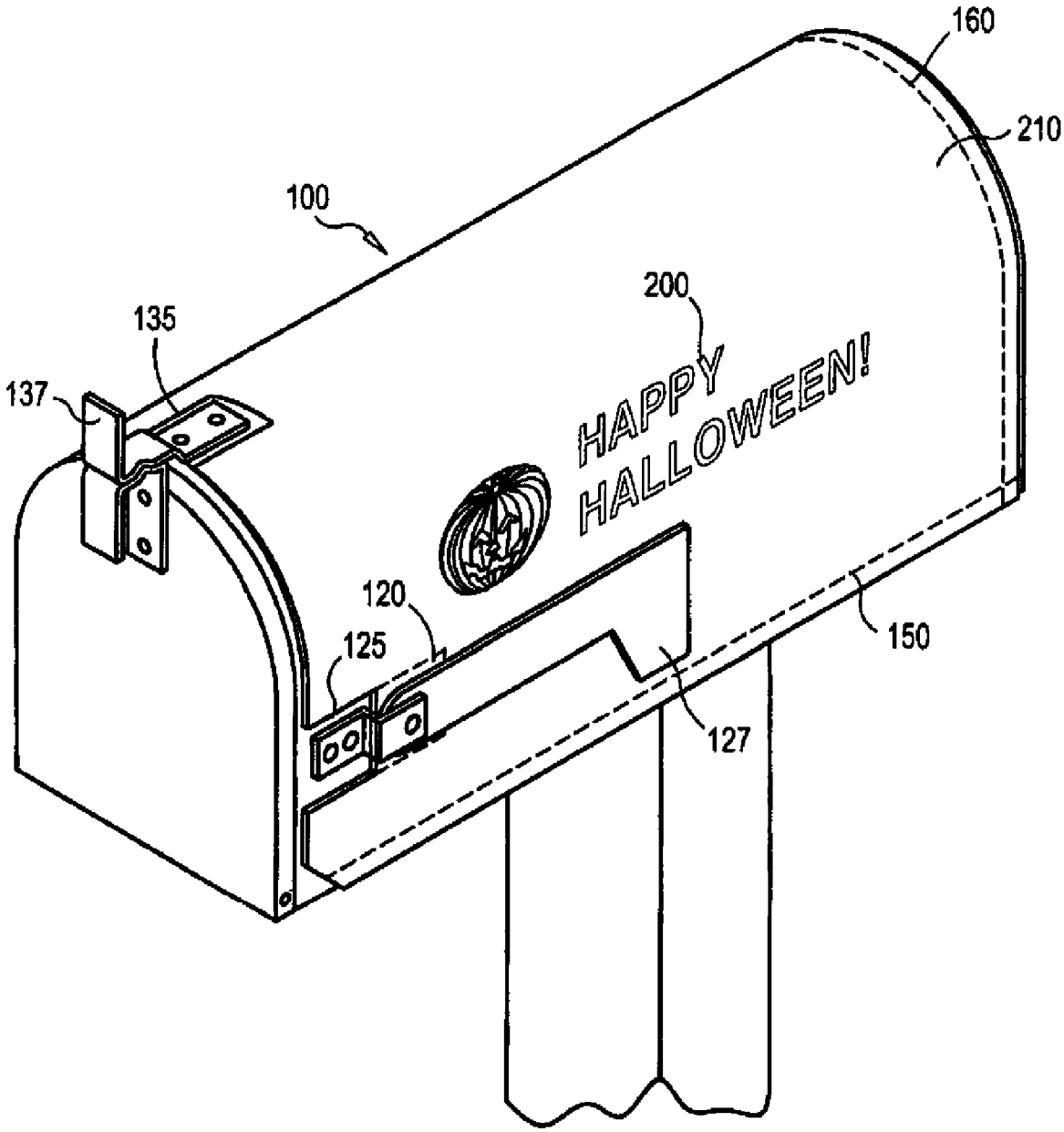
FIG. 5 is a perspective view of a mailbox with the cover installed thereon in accordance with an embodiment of the present invention.

Accordingly, sheet 100 is reversible so that decorative graphics 200 are facing outward as shown in FIG. 5. Decorative later 110 is placed over the mailbox and magnetic layer 325 is polarized such that its attractive magnetic forces pass through decorative layer 110 providing a means of securement to the mailbox and displaying decorative graphics 200, 205.

Referring now to FIG. 5 shows decorative layer 210 being displayed and installed on a mailbox. Tab 130 has been completely removed to allow the mailbox latch 137 to operate. Tab 120 is partially separated from sheet 100 and is folded back underneath sheet 110 so that it is hidden from view. This allows tab 120 to be replaced to its original position and fill in the void area when sheet 100 is reversed and it is tab 140 that is required to be partially removed to allow passage of flag 127 instead of tab 120. FIG. 5 shows a larger T2 sized mailbox so that excess material defined by cuts 160, 170 and 150 (not shown) is not removed.

Figure 6:
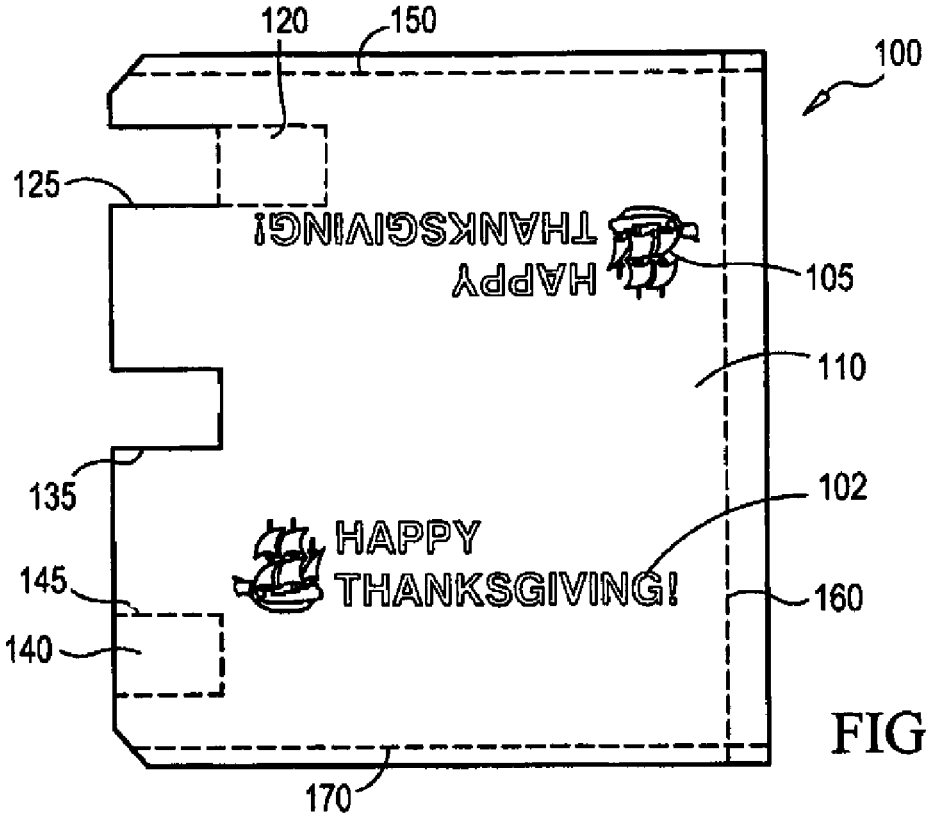
FIG. 6 is a plan view of a first side of the cover of an embodiment of the present invention shown in FIG. 5.
Figure 7:
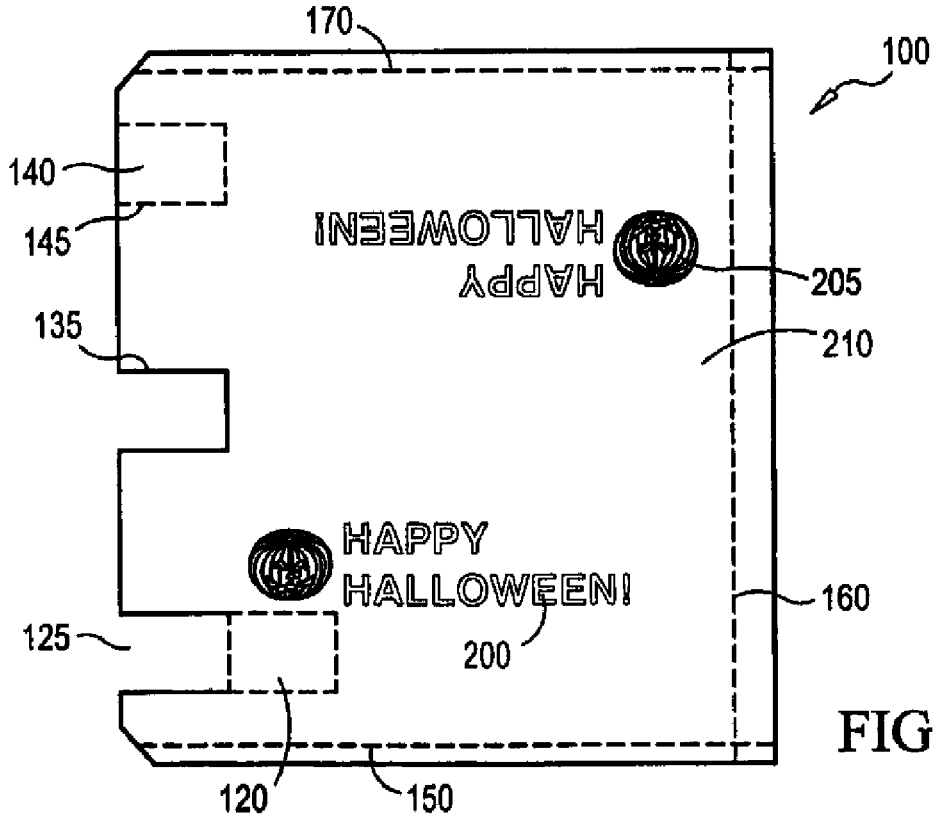
FIG. 7 is a plan view of a second side of the cover of an embodiment of the present invention shown in FIG. 5.

Referring now to FIG. 6 and FIG. 7 shows tab 120 folded back to allow passage of flag 127 and tab 140 remains at its original location as the aperture created by folding back tab 140 is not needed when displaying decorative layer 210.

Figure 9:
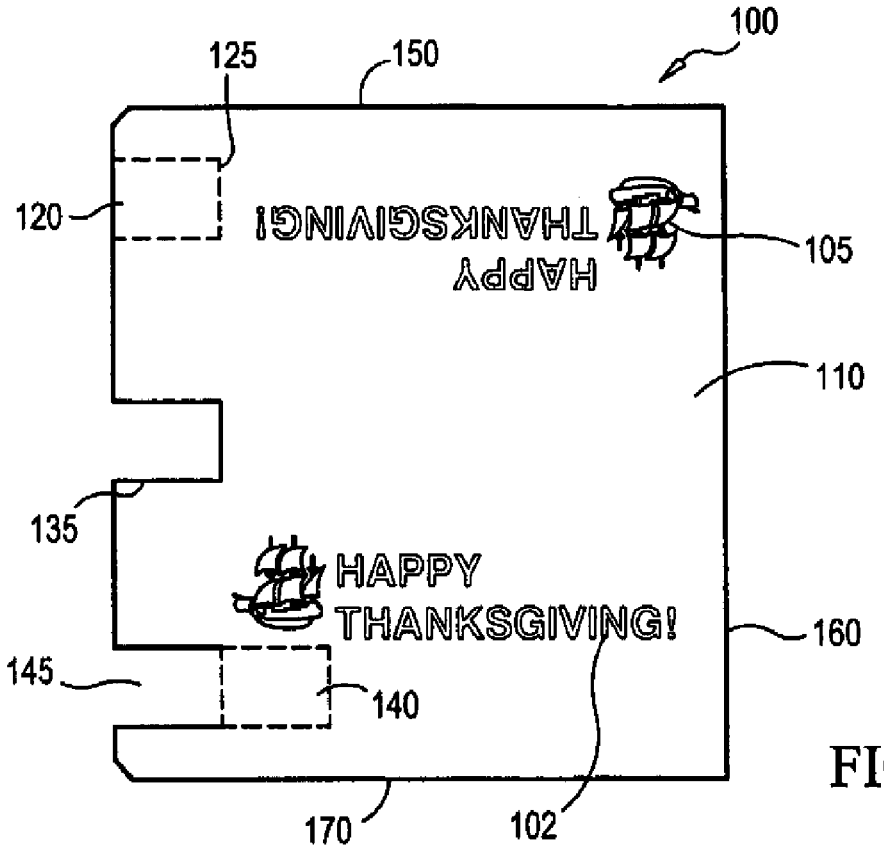
FIG. 9 is a plan view of a first side of the cover of an embodiment of the present invention shown in FIG. 8.
Figure 10:
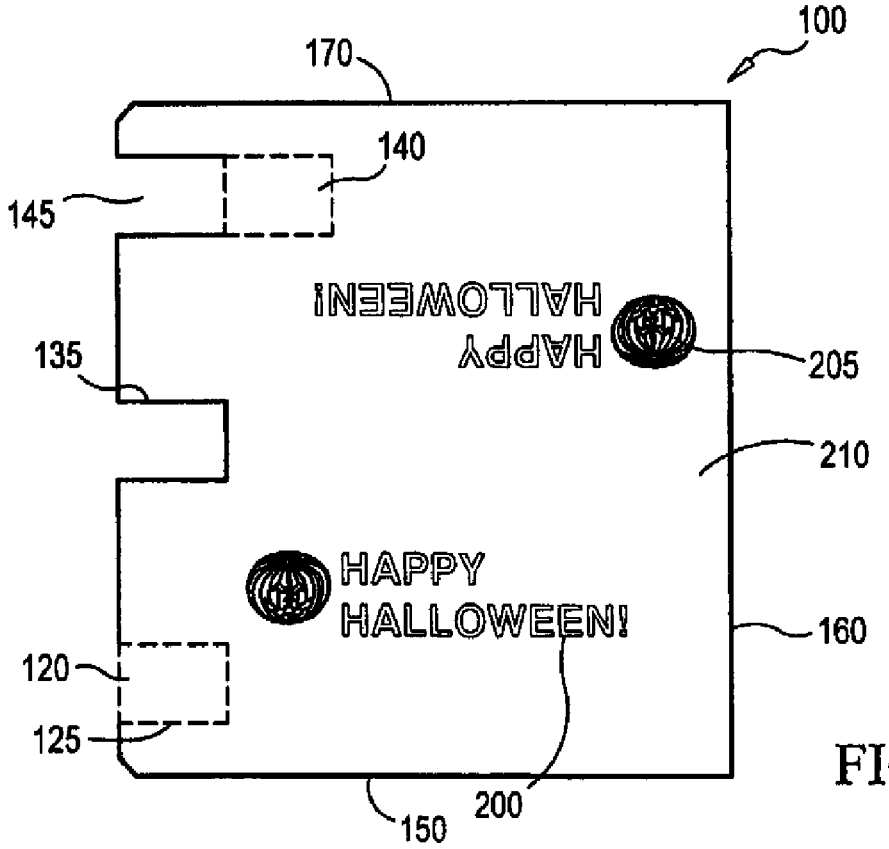
FIG. 10 is a plan view of a second side of the cover of an embodiment of the present invention shown in FIG. 8.

Referring now to FIG. 8 shows decorative layer 110 displayed. Tab 140 is folded back to allow passage of flag 127. Excess material along the edges of sheet 100 has been removed to fit the smaller T1 mailbox shown. Cuts 150, 160 and 170 (not shown) become the edges of sheet 110. FIG. 9 and FIG. 10 show decorative layers 110 and 210 with appropriate tab 130 removed for the proper orientation of sheet 100 on the mailbox as shown in FIG. 8.

Figure 11:
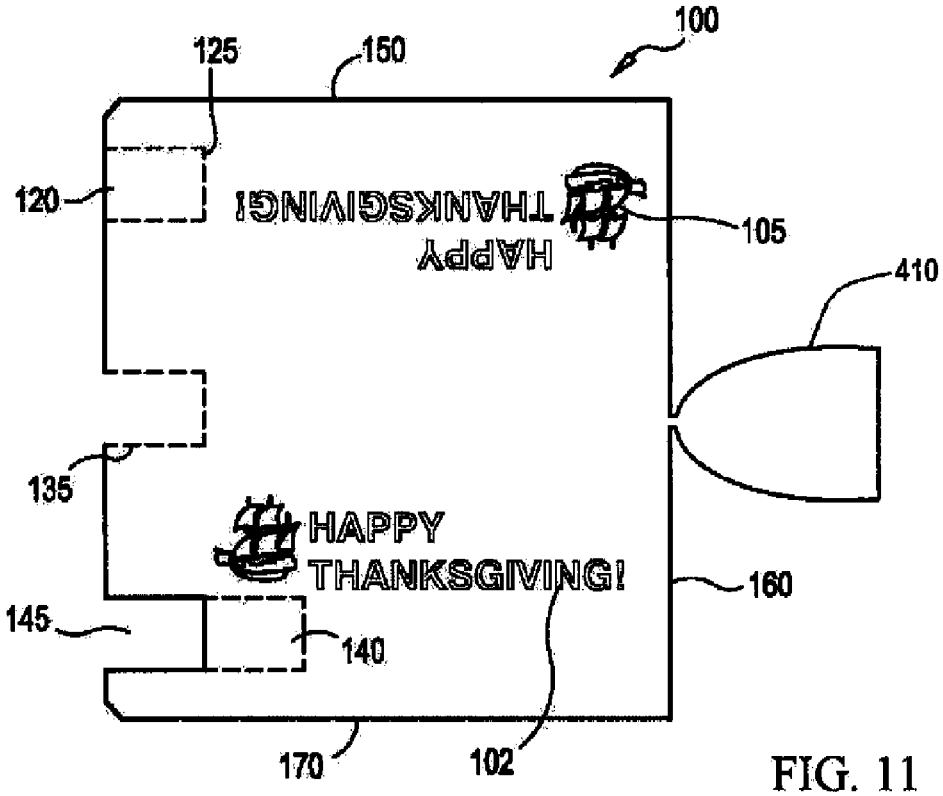
FIG. 11 is a plan view of a first side of the cover of an embodiment of the present invention showing the rear flap.
Figure 12:
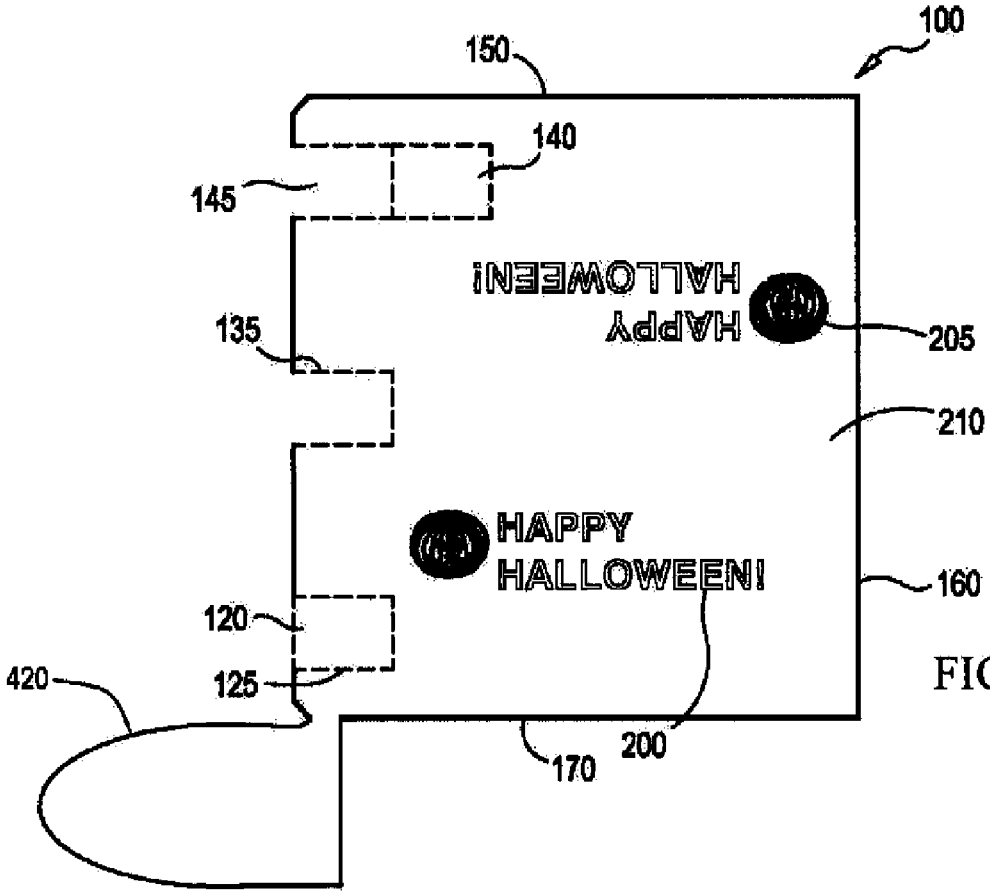
FIG. 12 is a plan view of a first side of the cover of an embodiment of the present invention showing the front flap.

Referring now to FIG. 11, in an alternative embodiment, sheet 100 also includes a rear flap 410 for securing to the back side of the mailbox. In another alternative embodiment, sheet 100 includes front flap 420 for securing to the mailbox door as shown in FIG. 12. By increasing the surface area of the cover by including either front flap 420 or rear flap 410 or both, increases the adhering power proportionally by the increase in surface area of the magnetized cover. In addition, the aesthetics of the mailbox are also improved.

In yet another alternative embodiment where the mailbox material is aluminum, plastic or other type of non-magnetic material, a plurality of magnetic swatches are provided to be secured to the mailbox. The magnetic swatches are secured first to the non-magnetic mailbox in strategic locations such as near the edges of the mailbox. Once the magnetic swatches are in place, the magnetic mailbox cover can then be installed over the swatches and mailbox as described above.

The particular embodiments disclosed above and in the drawings are illustrative only, as the invention may be modified and practiced in different but equivalent manners apparent to those skilled in the art having the benefit of the teachings herein. Furthermore, no limitations are intended to the details of construction or design herein shown. It is therefore evident that the particular embodiments disclosed above may be altered or modified and all such variations are considered within the scope and spirit of the invention.

It is also to be understood that the following claims are intended to cover all of the generic and specific features of the invention herein described, and all statements of the scope of the invention, which as a matter of language, might be said to fall therebetween.

Now that the invention has been described,

What is claimed is:

1. A mailbox cover comprising:

a flexible sheet comprising a composite of a plurality of layers;

said plurality of layers having a first layer decorated with graphics and an underlying second layer magnetically polarized in a first direction so that said second layer is magnetically attracted to a metal mailbox;

said plurality of layers further comprising an underlying third layer magnetically polarized in an opposing second direction to said second magnetically polarized layer so that said third layer is magnetically attracted to a metal mailbox and an underlying fourth layer decorated with graphics; and a front flap having a shape configured to conform to a door of a mailbox and contiguous and adjacent to a front edge and corner of said sheet.

2. The mailbox cover of claim 1, further comprising a first perforated tab disposed proximate to an edge of said sheet and defined by a first perforated cut wherein said first perforated tab having the ability to be folded back underneath said sheet forming a first notch in said sheet so that a mailbox flag is allowed passage.

3. The mailbox cover of claim 2, further comprising a second perforated tab equidistantly disposed opposing longitudinal edges of said sheet wherein said second tab is defined by a second perforated cut.

4. The mailbox cover of claim 3, further comprising a third tab defined by a third perforated cut wherein said third tab having the ability when in use to be folded back underneath said sheet forming a third notch in said sheet so that a mailbox flag is allowed passage.

5. The mailbox cover of claim 4, further comprising a rear perforated cut parallel to a rear edge of said sheet so that said rear perforated cut allows a strip of said sheet to be removed to reduce the length of said sheet.

6. The mailbox cover of claim 5, further comprising a pair of longitudinal perforated cuts disposed parallel to opposing longitudinal edges of said sheet so that said pair of longitudinal perforated cuts allow two strips of said sheet to be removed to reduce the width of said sheet.

7. The mailbox cover of claim 1, further comprising a rear flap having a shape configured to conform to a rear portion of a mailbox and contiguous and adjacent to a rear edge of said sheet.

8. A mailbox cover comprising:

a flexible sheet comprising a composite of a plurality of layers adapted for use outdoors on a metal mailbox;

said plurality of layers having a first layer decorated with graphics and an underlying second layer of similar size and shape of said first layer and magnetically polarized in a first direction so that said second layer is magnetically attracted to the metal mailbox wherein said first layer and said second layer form a laminate;

and a front flap having a shape configured to conform to a door of a mailbox and contiguous and adjacent to a front edge and corner of said sheet.

9. The mailbox cover of claim 8 further comprising a first notch positioned on said sheet so that a mailbox flag is allowed passage.

10. The mailbox cover of claim 9 further comprising a perforated tab defined by a perforated cut and said tab is removable to form a notch positioned on said sheet so that a mailbox latch operates without interference from said cover.

11. The mailbox cover of claim 8, further comprising a rear flap having a shape configured to conform to a rear portion of a mailbox and contiguous and adjacent to a rear edge of said sheet.

12. The mailbox cover of claim 8, further comprising a pair of longitudinal perforated cuts disposed parallel to opposing longitudinal edges of said sheet so that said pair of longitudinal perforated cuts allow two strips of said sheet to be removed to reduce the width of said sheet.

13. The mailbox cover of claim 12, further comprising a rear perforated cut parallel to a rear edge of said sheet so that said rear perforated cut allows a strip of said sheet to be removed to reduce the length of said sheet.

* * * * *